US006004156A

United States Patent [19]

Roque et al.

[11] Patent Number: 6,004,156

[45] Date of Patent: Dec. 21, 1999

[54] FLAT FLEXIBLE CABLE CONNECTOR

[75] Inventors: David Roque, Boiling Spring, S.C.; Eric Juntwait, Irvine, Calif.

[73] Assignee: Hon Hai Precision Ind. Co., Ltd., Taipei Hsien, Taiwan

[21] Appl. No.: 09/347,366

[22] Filed: Jul. 6, 1999

[51] Int. Cl.[6] ..... H01R 9/07

[52] U.S. Cl. ..... 439/495

[58] Field of Search ..... 439/495, 260

[56] References Cited

U.S. PATENT DOCUMENTS

| | | | |
|---|---|---|---|
| 4,808,113 | 2/1989 | Kanesige et al. | 439/495 |
| 5,308,262 | 5/1994 | Chishima | 439/495 |
| 5,370,552 | 12/1994 | Chishima et al. | 439/495 |
| 5,863,217 | 1/1999 | Ii et al. | 439/495 |
| 5,904,589 | 5/1999 | Asakawa | 439/495 |

*Primary Examiner*—Gary F. Paumen
*Attorney, Agent, or Firm*—Wei Te Chung

[57] ABSTRACT

A flat flexible cable connector includes an insulative housing defining a receiving cavity for movably receiving an actuator. The housing defines a plurality of channels for receiving and retaining conductive contacts. Each contact has a fixed arm retained in the housing and a resilient arm extending into the space. The actuator has a tongue insertable into the receiving cavity. The tongue has a top face for retaining a leading end of a flat flexible cable whereby when the tongue is inserted into the cavity, the flat flexible cable engages with the resilient arms of the contacts. A plurality of spaced slots are defined in a bottom face of the tongue for guidingly receiving the fixed arms of the contacts thereby guiding the insertion of the actuator into the housing and eliminating transverse oscillation of the actuator.

7 Claims, 4 Drawing Sheets

FLAT FLEXIBLE CABLE CONNECTOR

BACKGROUND OF THE INVENTION

1. Field of the Invention

The present invention generally relates to a flat flexible cable (FFC) connector, and in particular to an FFC connector having a contact alignment/stabilizing feature.

2. The Prior Art

Flat flexible cables (FFCs) are widely used to connect components, such as a printed circuit board, arranged in a confined space inside an electronic device, such as a computer, for reducing the overall size of the electronic device. An FFC may be directly connected to a circuit board by soldering. Alternatively, an FFC connector may be used to connect an FFC to a circuit board. Examples of FFC connectors are disclosed in U.S. Pat. Nos. 5,194,017, 5,308,262, 5,401,186, and 5,474,468.

An FFC connector comprises a housing retaining a plurality of conductive contacts therein. A receiving cavity is defined in the housing and exposed to an opening thereof. An actuator defining a recess on a top side thereof for receiving an FFC is inserted into the receiving cavity through the opening. The contacts extend into the cavity and electrically engage with the FFC when the FFC is brought into the cavity by the actuator. The actuator is provided with side latches on opposite sides thereof for engaging with corresponding projections formed on the housing thereby securing the actuator to the housing.

During insertion into the cavity of the housing, the actuator is not only moved into the receiving space, but also oscillates in a transverse direction with respect to the housing and may become skewed. The oscillation or skewing of the actuator, if not properly controlled, may damage or even break the side latches. Furthermore, the conventional FFC connector does not have guiding means for properly guiding the actuator into the housing. Thus, undesired mechanical interference may occur between the actuator and the conductive contacts.

It is thus desired to provide an FFC connector comprising a contact alignment/stabilizing feature for addressing the above problems.

SUMMARY OF THE INVENTION

Accordingly, an object of the present invention is to provide an FFC connector comprising means to reduce transverse oscillation or skewing of an actuator thereof.

Another object of the present invention is to provide an FFC connector comprising means for properly aligning an actuator with conductive contacts mounted in a housing thereof when the actuator is inserted into the housing.

A further object of the present invention is to provide an FFC connector comprising means for stabilizing conductive contacts when an actuator engages with a housing thereof.

To achieve the above objects, a flat flexible cable connector in accordance with the present invention comprises an insulative housing defining a receiving cavity for movably receiving an actuator. The housing defines a plurality of channels for receiving and retaining conductive contacts. Each contact has a fixed arm retained in the housing and a resilient arm extending into the space. The actuator has a tongue insertable into the receiving cavity. The tongue has a top face for retaining a leading end of a flat flexible cable whereby when the tongue is inserted into the cavity, the flat flexible cable engages with the resilient arms of the contacts. A plurality of spaced slots are defined in a bottom face of the tongue for guidingly receiving the fixed arms of the contacts thereby guiding the insertion of the actuator into the housing and eliminating transverse oscillation of the actuator.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
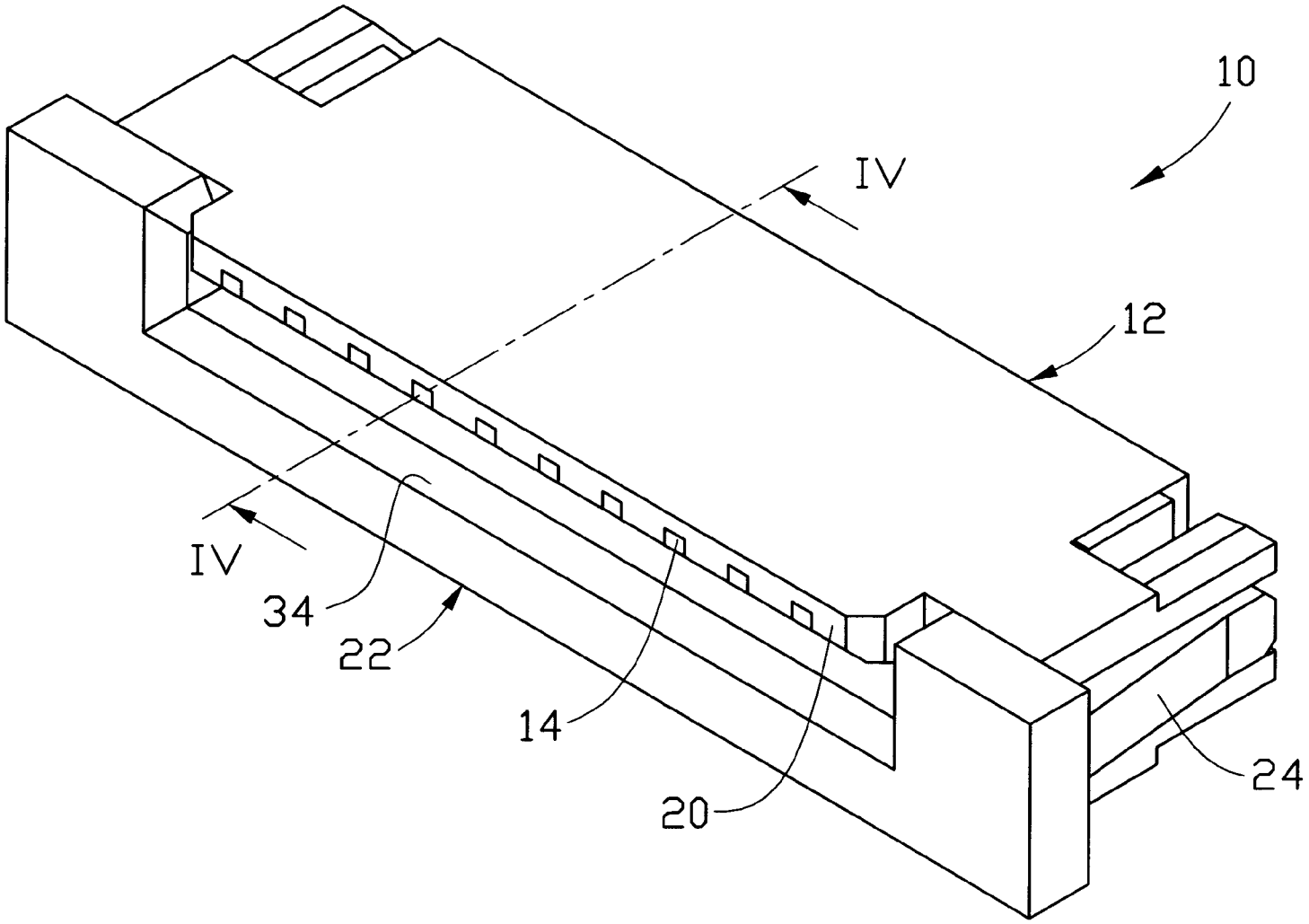
FIG. 1 is a perspective view of a flat flexible cable connector constructed in accordance with the present invention at a closed position.
Figure 2:
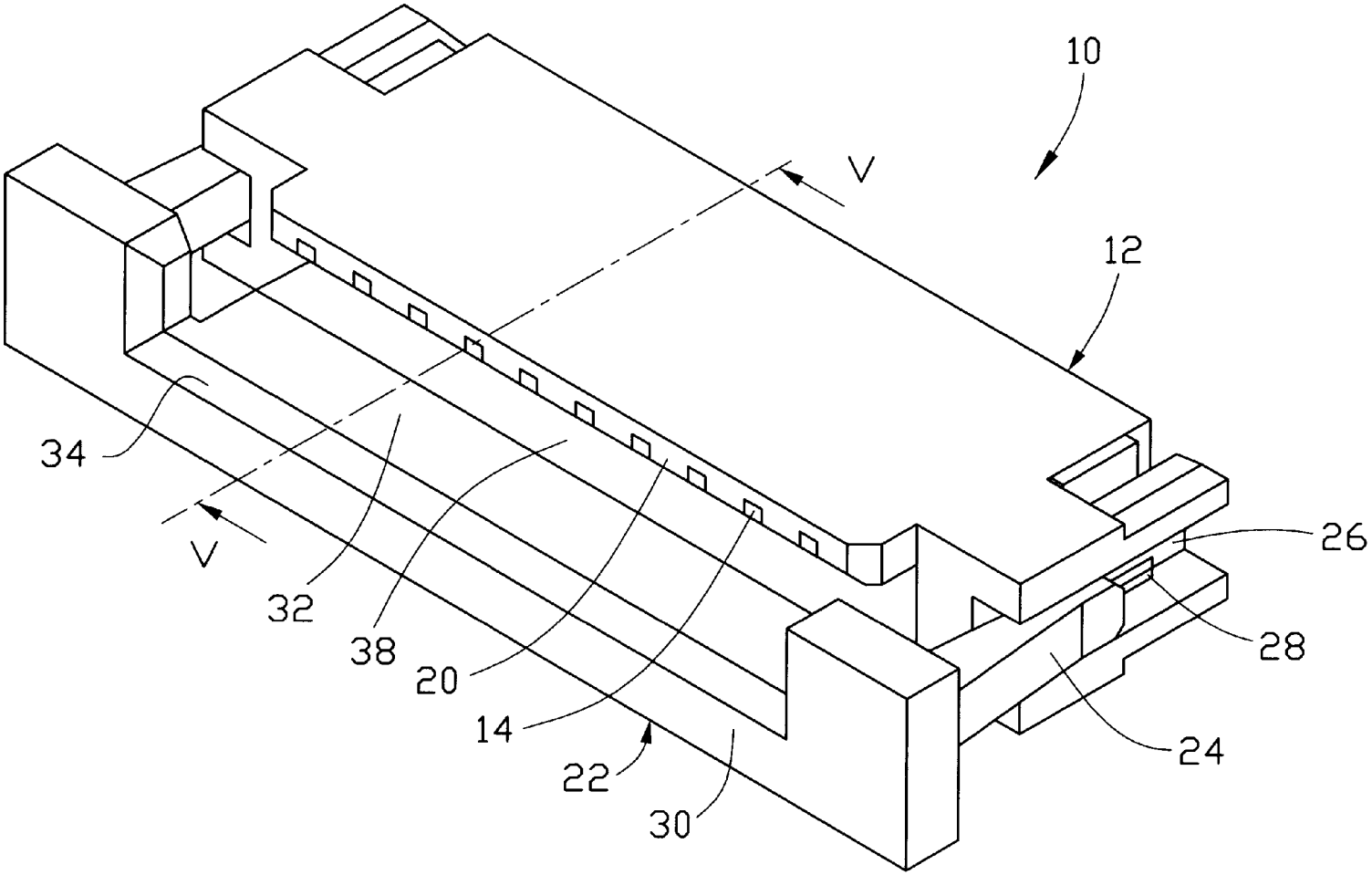
FIG. 2 is similar to FIG. 1 but showing the flat flexible connector at an open position.
Figure 4:
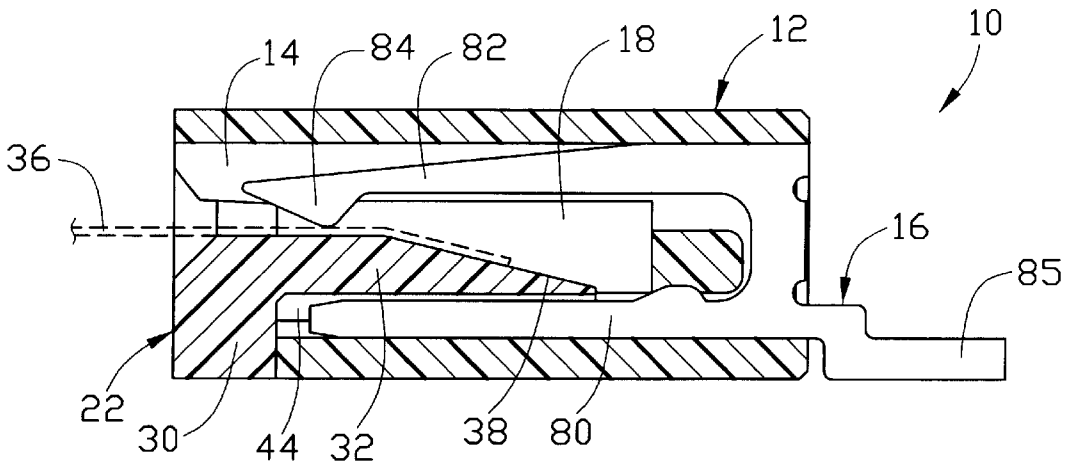
FIG. 4 is a cross-sectional view taken along line VI—VI of FIG. 1.
Figure 5:
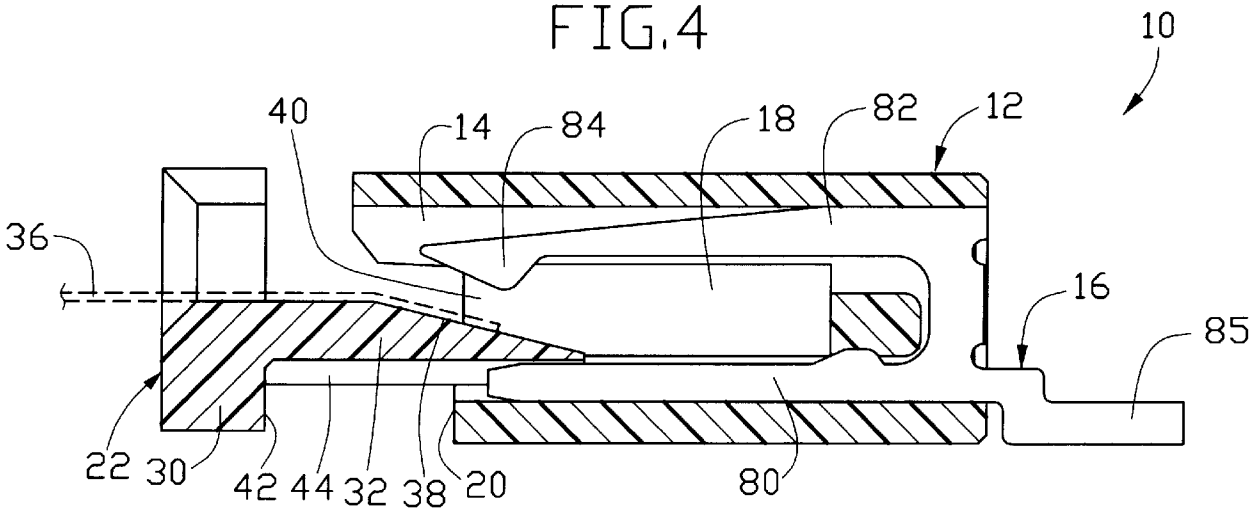
FIG. 5 is a cross-sectional view taken along line V—V of FIG. 2.

Referring to the drawings and in particular to FIGS. 1 and 2, a flat flexible cable (FFC) connector 10 constructed in accordance with the present invention comprises an insulative housing 12 defining a plurality of spaced channels 14 therein for receiving and retaining conductive contacts 16 (FIGS. 4 and 5). A receiving space 18 (FIGS. 4 and 5) is defined in the housing 12 and is exposed to a front face 20 thereof for movably receiving an actuator 22. The actuator 22 is movable with respect to the housing 12 between an open position (FIGS. 2 and 5) and a closed position (FIGS. 1 and 4).

As shown in FIGS. 4 and 5, each contact 16 comprises a fixed arm 80 interferentially fit in the corresponding channel 14 and an opposing resilient arm 82 which has a barbed free end 84 extending into the receiving space 18. The contact 16 also has a tail 85 extending beyond the housing 12 for being soldered to a printed circuit board (not shown).

Figure 3:
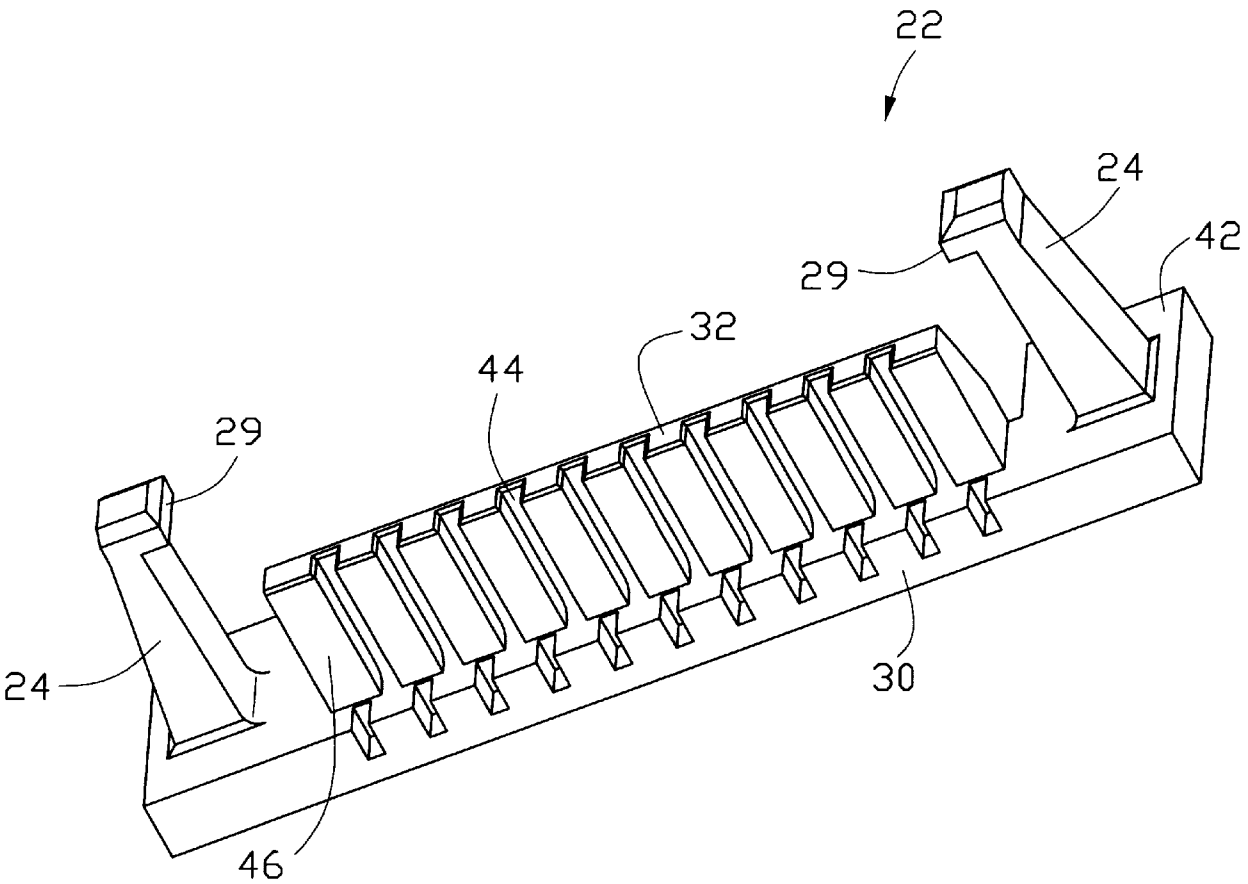
FIG. 3 is a bottom perspective view of an actuator of the flat flexible cable connector.

With further reference to FIG. 3, the actuator 22 is made of an insulative material forming two side latches 24 on opposite ends thereof. A pair of inwardly extending barbs 29 is formed on free ends of the side latches 24. The side latches 24 are guidingly and movably received in guide slots 26 (FIG. 2) defined in opposite distal ends of the housing 12 for guiding the relative movement between the actuator 22 and the housing 12. A projection 28 (FIG. 2) is formed in each guide slot 26 for engaging with the barb 29 of the corresponding side latch 24 to retain the actuator 22 at the closed position. Preferably, a stop (not shown) in the form of a projection is formed in each guide slot 26 of the housing 12 and engages with the barb 29 of the corresponding side latch 24 for preventing the actuator 22 from separating from the housing 12.

The actuator 22 comprises a base section 30 and a tongue 32 receivable in the space 18 of the housing 12. The base section 30 defines a top recess 34 for receiving and supporting a flat flexible cable 36 (phantom lines of FIGS. 4 and 5). The cable 36 extends over the tongue 32 whereby when the actuator 22 is moved to the closed position and the tongue 32 is inserted into the space 18, a leading end of the cable 36 is moved into the space 18 and electrically engages with the barbed free ends 84 of the corresponding contacts 16 as shown in FIG. 4.

Preferably, the tongue 32 forms an inclined top surface 38 and a gap 40 is formed between the top surface 38 and the barbed ends 84 of the contacts 16 for accommodating the leading end of the cable 36 when the actuator 22 is at the open position as shown in FIG. 5. The base section 30 has a stop face 42 abutting against the front face 20 of the housing 12 when the actuator 22 is moved to the closed position as shown in FIG. 4.

A plurality of spaced slots 44 are defined in a bottom face 46 of the tongue 32 corresponding to the fixed arms 80 of the contacts 16 whereby when the actuator 22 is moved from the open position to the closed position, the fixed arms 80 are guidingly received in the slots 44 for guiding the movement of the actuator 22 with respect to the housing 12 and thus preventing lateral movement of the actuator 22 with respect to the housing 12. The engagement between the slots 44 and the fixed arms 80 of the contacts 16 also serves to stabilize the contacts 16 during the mating engagement of the actuator 22 and the housing 12.

Although the present invention has been described with reference to the preferred embodiment, it is apparent to those skilled in the art that a variety of modifications and changes may be made without departing from the scope of the present invention which is intended to be defined by the appended claims.

What is claimed is:

1. A flat flexible cable connector comprising:

an insulative housing defining a receiving cavity and retaining a plurality of conductive contacts, each contact having a fixed arm fixed in the housing and an opposing resilient arm extending into the cavity; and an actuator comprising a tongue received in the cavity and movable between a closed position and an open position, the tongue having a top face adapted to retain a portion of a flat flexible cable whereby when the tongue is moved to the closed position, the portion of the flat flexible cable is moved into the cavity and electrically engages with the resilient arms of the contacts, a plurality of spaced slots being defined in a bottom face of the tongue corresponding to the fixed arms of the contacts whereby when the tongue is moved from the open position to the closed position, the fixed arms of the contacts are guidingly received in the slots for guiding the movement of the actuator.

2. The flat flexible cable connector as claimed in claim 1, wherein the actuator forms two side latches guidingly and movably received in guide slots defined in opposite ends of the housing.

3. The flat flexible cable as claimed in claim 2, wherein each side latch forms an inward barb for selectively engaging with projections formed in the corresponding guide slot to retain the actuator at the closed position and the open position.

4. The flat flexible cable connector as claimed in claim 1, wherein the resilient arm of each contact has a barbed free end for electrically engaging with the flat flexible cable.

5. The flat flexible cable connector as claimed in claim 1, wherein a recess is defined in the actuator for receiving and retaining the flat flexible cable.

6. The flat flexible cable connector as claimed in claim 1, wherein the top face of the tongue is inclined.

7. The flat flexible cable connector as claimed in claim 1, wherein each contact comprises a tail extending beyond the housing and adapted to be soldered to a circuit board.

* * * * *